US009603465B2

(12) United States Patent
Winger

(10) Patent No.: US 9,603,465 B2
(45) Date of Patent: Mar. 28, 2017

(54) COLLAPSIBLE AND FLEXIBLE SHOULDER-CARRYING DEVICE

(71) Applicant: Julius Andreas Winger, Oslo (NO)

(72) Inventor: Julius Andreas Winger, Oslo (NO)

( * ) Notice: Subject to any disclaimer, the term of this patent is extended or adjusted under 35 U.S.C. 154(b) by 0 days.

(21) Appl. No.: 14/651,112

(22) PCT Filed: Dec. 18, 2012

(86) PCT No.: PCT/NO2012/000071
§ 371 (c)(1),
(2) Date: Jun. 10, 2015

(87) PCT Pub. No.: WO2014/092580
PCT Pub. Date: Jun. 19, 2014

(65) Prior Publication Data

US 2015/0313376 A1 Nov. 5, 2015

(30) Foreign Application Priority Data

Dec. 11, 2012 (NO) ..... 20121493

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/02; A45B 11/02; A45B 11/04; A45F 3/10
(Continued)

(56) References Cited

U.S. PATENT DOCUMENTS 3,610,489 A 10/1971 Parsons
3,698,608 A 10/1972 Entwistle
(Continued)

FOREIGN PATENT DOCUMENTS

DE 29603884 U1 * 8/1996 ..... A47D 13/025
FR 2 571 238 A1 4/1986
(Continued)

OTHER PUBLICATIONS

Nordic Patent Institute; International Search Report in International Patent Application No. PCT/NO2012/000071 (Jun. 3, 2014).
(Continued)

*Primary Examiner* — Justin Larson
*Assistant Examiner* — Scott McNurlen
(74) *Attorney, Agent, or Firm* — Leydig, Voit & Mayer, Ltd.

(57) ABSTRACT

A collapsible flexible shoulder-borne carrying device includes a dividable lumbar support with a support bar attached to the lumbar support. The support bar extends transversely from the lumbar support at a point of attachment. The upper part of the support bar is rigid, and the lower part of the support bar has a free end that is pliable and bent inward toward the lower part of the lumbar support to provide an open arch. A length-adjustable support harness with fasteners is secured to the free end of the support bar and is secured to a free end of the lumbar support to fasten the open arch in a desired position. A seat cover has at least one safety strap and at least one leg restraint in a lower part of the seat cover. At least one support strap is fastened to the upper part of the lumbar support.

6 Claims, 5 Drawing Sheets

(58) Field of Classification Search
USPC ..... 224/181, 158–161, 186–190
See application file for complete search history.

(56) References Cited

U.S. PATENT DOCUMENTS

| | | | | | |
|---|---|---|---|---|---|
| 3,968,910 | A * | 7/1976 | Dye | A47D 13/025 | 224/161 |
| 4,416,403 | A * | 11/1983 | Johnson | A47D 13/025 | 224/159 |
| 4,484,700 | A * | 11/1984 | Bush | A47D 13/025 | 224/159 |
| 4,746,044 | A * | 5/1988 | Arvizu | A47D 13/025 | 224/155 |
| 4,967,943 | A * | 11/1990 | Massey | A45B 11/02 | 224/189 |
| 5,660,435 | A * | 8/1997 | Eichhorn | B62B 7/08 | 224/281 |
| 6,561,394 | B2 | 5/2003 | Pripps et al. | | |
| 2002/0179654 | A1 | 12/2002 | Pripps et al. | | |
| 2007/0039983 | A1 * | 2/2007 | Harrison, III | A45F 5/00 | 224/265 |
| 2008/0041906 | A1 * | 2/2008 | Rose | A45C 13/30 | 224/628 |

FOREIGN PATENT DOCUMENTS

| | | | |
|---|---|---|---|
| GB | 2 076 636 | B | 12/1983 |
| GB | 2 378 889 | A | 2/2003 |
| NL | 1009604 | C | 11/2000 |
| NO | 29111281 | A1 | 3/2013 |

OTHER PUBLICATIONS

International Bureau of WIPO; Written Opinion in International Patent Application No. PCT/NO2012/000071 (Jun. 16, 2015).

* cited by examiner

COLLAPSIBLE AND FLEXIBLE SHOULDER-CARRYING DEVICE

CROSS-REFERENCE TO RELATED APPLICATIONS

This patent application is a U.S. national stage application of PCT Patent Application No. PCT/NO2012/000071, filed Dec. 18, 2012, published as WIPO publication No. WO 2014/092580, which claims priority to Norwegian Patent Application No. PT 20121493, filed December 2012. PCT Patent Application No. PCT/NO2012/000071 and Norwegian Patent Application No. PT 20121493 are incorporated by reference.

TECHNICAL FIELD

The present invention relates to a collapsible and flexible shoulder-carrying device.

BACKGROUND OF THE INVENTION

Previous Solutions

There are several known methods for carrying a person, usually a child, on the shoulders, back or front of another person. Units that position the child on the back or front of the bearer have the disadvantage of placing a considerable load on the bearer's torso, thus causing major strain on the waist and also on the shoulders, through the shoulder straps. These points render the carrying of children larger than a small infant virtually impossible. The ideal position for the child's gravity point should be as close as possible to the vertical centre line of the bearer.

This would indicate that the ideal position for the load is on the bearer's head. For all practical purposes, however, the ideal position for carrying any major load, especially a child, will be on the bearer's shoulders.

The preferred method should be structured so as to attach the child to the unit, which is turn is attached to the bearer, whose arms and hands will be kept free.

Moreover, in order to ensure the safety of the child, the preferred method should permit the child to be attached to the unit before it is placed on the bearer's shoulders. The preferred method should also be easy to assemble/disassemble. Nor should the bearer need assistance from a third party to perform this task.

Among other known technical solutions, reference is made to:

U.S. Pat. No. 3,968,910. U.S. Pat. Nos. 4,416,403, 4,484,700, U.S. Pat. No. 4,416,403, U.S. Pat. No. 4,484,700, U.S. Pat. No. 3,968,910, U.S. Pat. No. 6,561,394, FR 2571238 AI, U.S. Pat. No. 3,610,489 A, U.S. Pat. No. 3,698,608 A, NL 1009604 C2.

The disadvantages of the known solutions include their failure to solve the problems associated with safe and transparent assembly and disassembly, fatigue in the bearer during transport of the load and space requirements in the storage state.

BRIEF SUMMARY OF THE INVENTION

According to an embodiment, the device may include a collapsible lumbar support with a spring-loaded hinge joint flexible support bars, seat cover with leg restraint, waistband and support straps, a support harness with tubular sleeves for the support bars, and a sleeve for the lumbar support, and safety straps with lock and adjustment.

BRIEF DESCRIPTION OF THE SEVERAL VIEWS OF THE DRAWING(S)

The present invention will be understood more easily with support from the corresponding figures.

DETAILED DESCRIPTION OF THE INVENTION

Collapsible and Flexible Shoulder-Carrying Device

The invention is a carrying system that helps an adult carry a child safely on his/her shoulders. The child is secured to the carrying device, which in turn is attached to the person who will carry the child, by pulling the device over his/her shoulders from above. The carrying device is collapsible, and the idea is that the adult will be able to unfold the carrying device and fasten the child into it without having to let go of the child.

Accordingly, only one hand should be needed to bring the carrying device from a folded to a functional state. This is achieved with the aid of a spring-loaded hinge joint that permits the carrying device to be folded in two lengthwise. Moreover, the flexible support bars can be folded inwards, making the device significantly smaller in depth. In its packed state, the carrying device is thus well under half the size it is in its functional state. The carrying device consists of a rigid frame of a suitable size and material, clad in textile and equipped with various straps and fastening devices to ensure that the child is held in place in the carrying device and also to ensure that the carrying device is fastened safely to the bearer.

The disadvantages of the known solutions include their failure to solve the problems associated with safe and transparent assembly and disassembly, fatigue in the bearer during transport of the load and space requirements in the storage state.

FIGS. 1-4 show a collapsible and flexible shoulder-carrying device according to embodiments of the invention.

Figure 1:
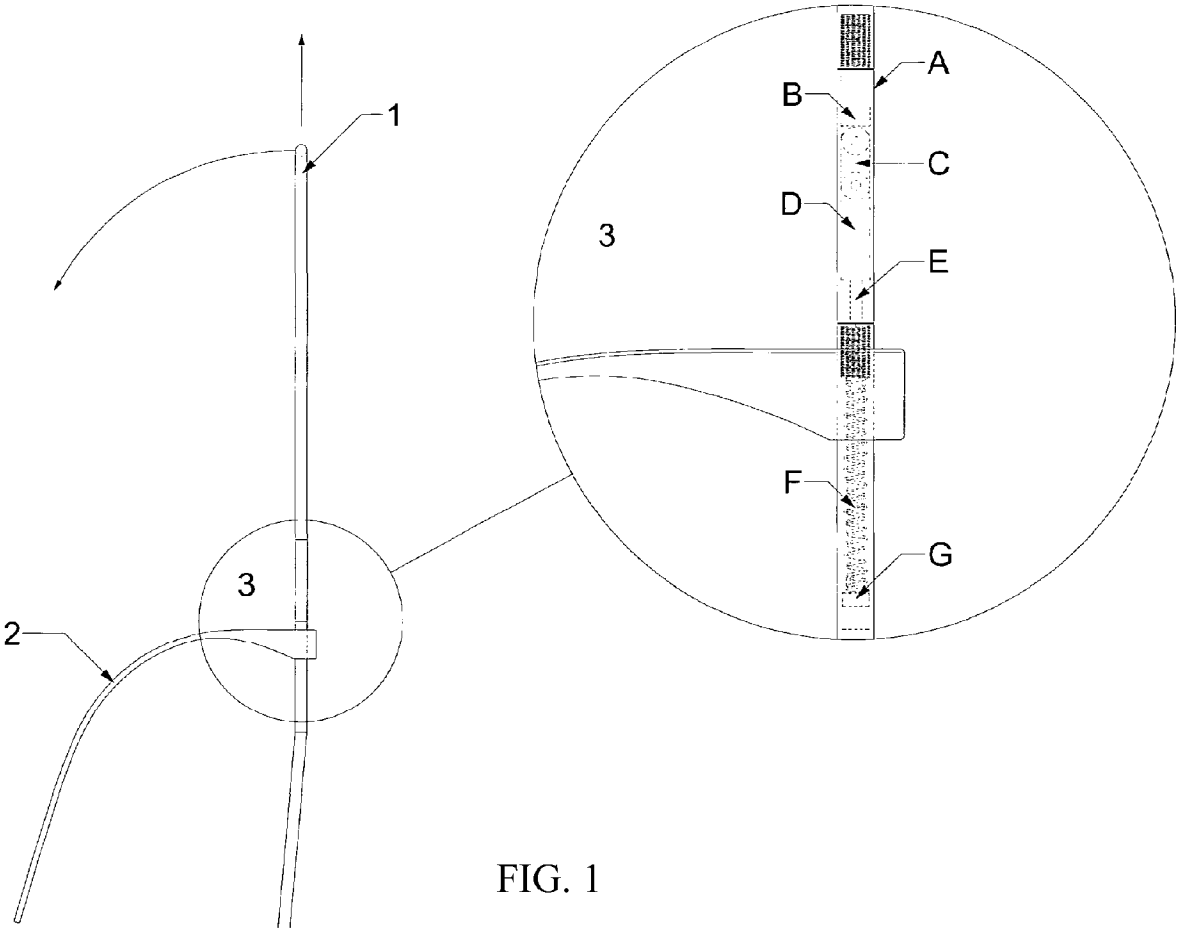
FIG. 1 shows a collapsible and flexible shoulder-carrying device according to an embodiment of the invention.
Figure 2:
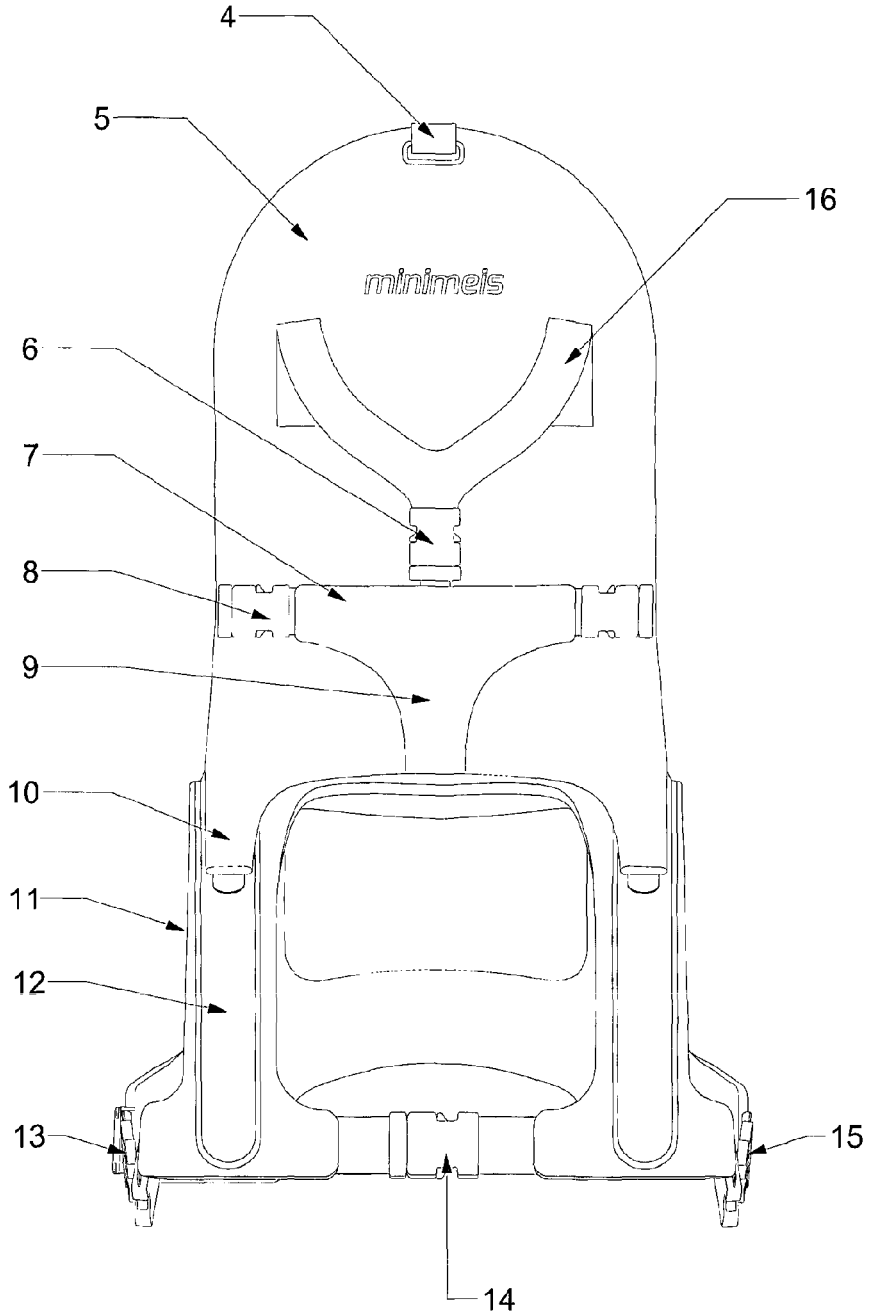
FIG. 2 shows a collapsible and flexible shoulder-carrying device according to an embodiment of the invention.

As illustrated in FIGS. 1 and 2, the objective of the invention is achieved through the four main parts of the device: a collapsible lumbar support (1) with a spring-loaded hinge joint (3A, 3B, 3C, 3D, 3E, 3F, 3G) flexible support bars (2), seat cover (5) with leg restraint (9), waistband (7) and support straps (16), a support harness (11) with tubular sleeves (12) for the support bars, and a sleeve (18) for the lumbar support, and safety straps (13 14 15) with lock and adjustment.

Figure 4:
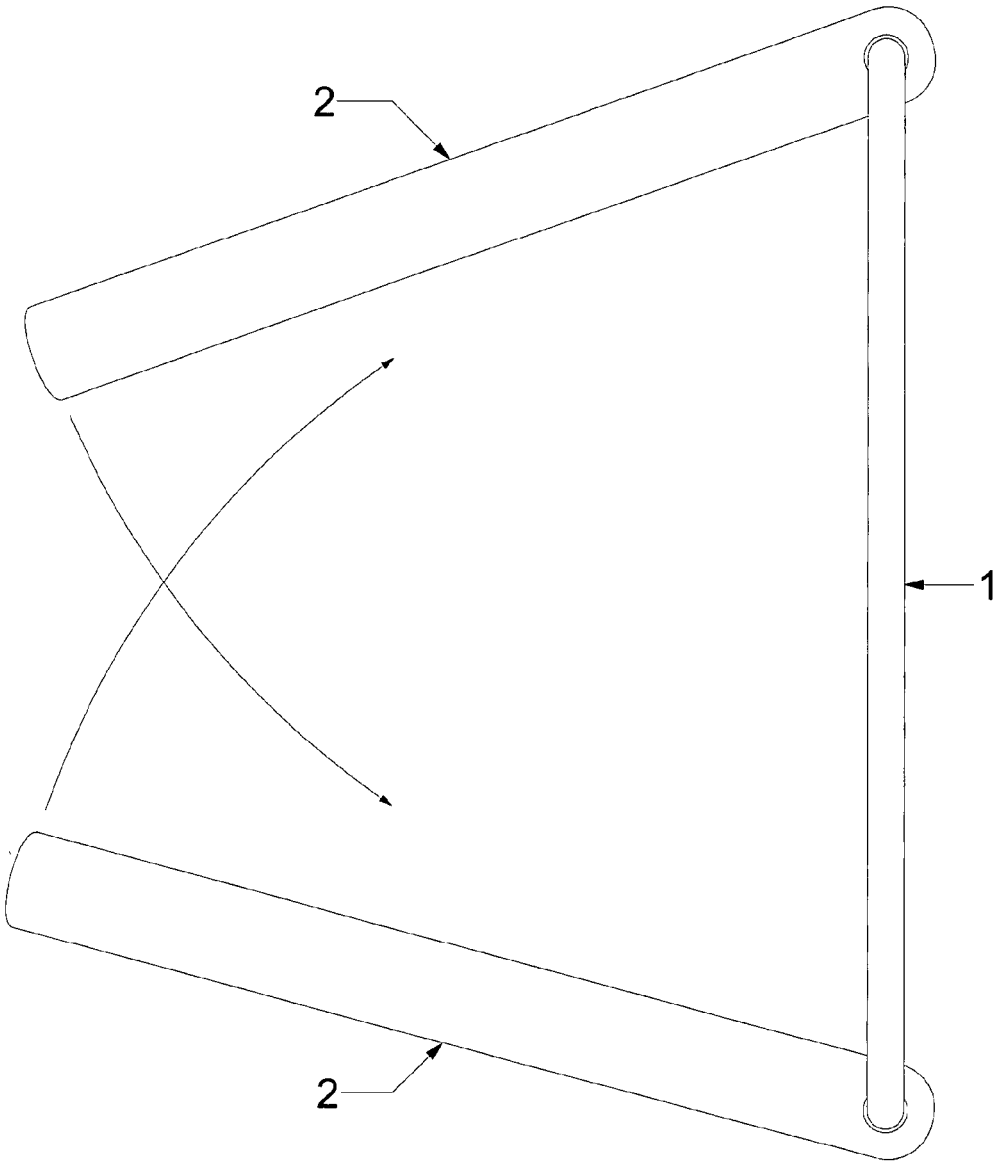
FIG. 4 shows a collapsible and flexible shoulder-carrying device according to an embodiment of the invention.

As illustrated in FIG. 4, the support bars (2) are rotatably attached to the lumbar support (1) with through-going holes, thus protruding near-horizontally from the point where they are attached to the lumbar support. The upper part of the support bars (2) are stiff, curving down from the horizontally in the longitudinal direction the lower part of the support bars towards the open end, and are pliable to permit them to be bent further towards the lumbar support.

Figure 3:
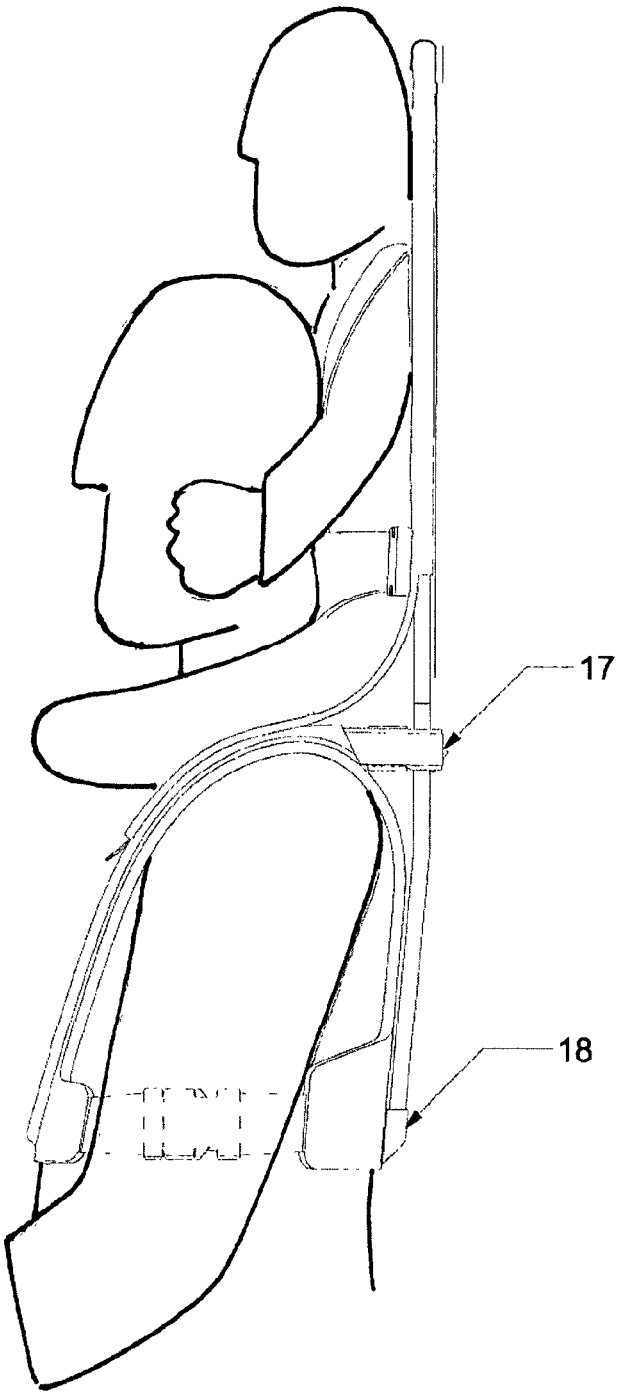
FIG. 3 shows a collapsible and flexible shoulder-carrying device according to an embodiment of the invention.

As illustrated in FIGS. 1-3, the support bars (2) are inserted into sleeves (12) on the front side of the support harness and fastened to the harness with a safety strap (17) in sleeves. At the back of the upper part of the support bars, the lumbar support is fastened in sleeve-pockets (18) on the lower part of the support harness, creating an open arch between the lumbar support and the support bar and an open arch between the support bars. Length-adjustable safety straps (14) with fasteners connect the two support bars at the front on the inside of the free end of the support bars to adjust for the bearer's shoulder/chest width. Safety straps (13 15) connect the support bars and the lumbar support on the outside on each side of the carrying device to adjust for body mass. In this way the open arches between the lumbar support and the support bars and between the support bars are closed. The support harness (11) holds the lumbar support and the support bars in the desired position and serves as a cushion between the bearer and the carrying device. The support harness is provided with safety straps around the support bars to fasten the child's legs to the support bars during assembly. The seat cover (5) is constructed with an inner sleeve to permit it to be pulled over the lumbar support and fastened to the upper section of the lumbar support. The seat cover is equipped with a leg restraint (9) the upper part of which is provided with a horizontal hole through which a safety strap (7) with lock and length adjustment (8) is attached to. Both outer vertical edges of the seat cover are threaded. The lower end of the leg restraint is attached to the lower end of the seat cover to form a seat/seating cavity the lower part of the seat cover. The ends in two textile straps (10) are provided with Velcro/snap fasteners for attaching them to the support harness/support bars. The seating height can be adjusted by fastening the textile straps further down towards the free end of the support bars. The seat cover is equipped with safety straps (16) of adjustable length permanently fastened to the seat cover towards the upper end of the seat cover, which is placed over the child's shoulders and attached to the leg restraint by a fastener with a safety strap that is adjustable in length (6). The seat cover is constructed with a through-going hole near the upper end, and at the centre of the width of the lumbar support, a locking strap (4) is threaded through the hole and locked to attach the seat cover firmly to the lumbar support. The strap acts as a counterweight when the spring in the joint is to be compressed, when the carrying device is to be taken from its functional to its packed state and to maintain the carrying device in its packed state, The seat cover can be easily removed from the carrying device by unfastening the strap that locks the seat cover to the lumbar support and pulling the seat cover from the lumbar support for easy cleaning.

FIG. 1 shows details of the lumbar support according to an embodiment of the invention.

The lumbar support may be folded and is equipped with a spring-loaded hinge joint (3A, 3B, 3C, 3D, 3E, 3F, 3G). In its packed state, the springs in the joint are compressed. And when the carrying device is held by its upper part and the strap that keeps the carrying device folded is untied, the force of gravity will cause the lower part to rotate around the axis of the joint. When the rotation completes 180 degrees, the compressed springs will pull the parts of the joint together and lock them in position. As soon as they reach a relative orientation that permits this, the interlocking is ensured by permitting the lower part to penetrate a certain distance into the upper part to achieve a stiff joint. The joint has been constructed in this manner to avoid external locking mechanisms that the child can reach and open during transport causing the lumbar support to fall away. The child and the bearer together create even more counterweight in the assembled state. On the area that may be folded, the length that the two parts are allowed to interlock will decide the stiffness of the joint. The joint is an integrated part of the lumbar support. The joint is positioned approximately halfway along the length of the lumbar support measured along the height of the carrying device. The part of the lumbar support that contains the joint is fastened with threading on the upper and lower part of the lumbar support. We can refer to this part as the joint element. The joint element (3A, 3B, 3C, 3D, 3E, 3F, 3G) is slightly less than 10 cm in length measured when the carrying device is in its functional state. The joint element consists of several parts. The flexible part consists of two massive pins (3B 3D) attached to a third massive part (3C). The latter is attached to the two pins so that the joint is free to bend in only one direction. This is not a ball joint but a joint with one degree of freedom, a hinge joint. The purpose of the connection between the two pins is to permit the carrying device to be completely folded up during transport. At the same time, this is a simple method for joining the two parts. A thin rod (3E) has been screwed into the lower pin onto this rod. Three objects have been placed starting from the top proceeding to the bottom. the following objects have been placed onto this thin rod: a casing (3A) of the same dimension as the lumbar support fastened with threading to the lower part, followed by a spring (3F) of suitable stiffness, and a fastening screw (3G) screwed into the lower part of the thin rod. The function of this screw is to ensure that the springs are kept in place and to provide the springs with a lock, permitting them to be compressed. The lower part of the lumbar support is screwed to the casing, which can move up and down along the hinge joint, and depending on the position of the hollow piece create a stiff or flexible joint. It can be added that the thin rod, the length of which is determined by the difference in length between the springs in their compressed and relaxed states, is longer than the outer dimensions of the joint element itself. In other words, it runs a certain distance down into the lower part of the lumbar support. This is because the springs must be sufficiently compressed to permit the hinge joint to be bent. These dimensions are determined by the dimensions and choices of materials for the other parts, which again are determined by the requirements to the durability of the construction. when the joint element is mounted on the lumbar support, the result is a construction which is reinforced and secured in its functional state, but with the aid of appropriate force can be sufficiently separated to permit bending and transforming the device from its operational to its packed state. this enables the bearer to maintain full control over the child using one arm and to put the carrying device in its functional state using the other arm, before securing the child in the carrying device and lifting this frontally up over his/her head and placing the carrying device onto his/her shoulders from above, locking and adjusting the safety straps that connect the outer end of the support bars with the outer end of the lumbar support, and locking and adjusting the safety strap that connects the parallel insides of the support bars frontally, so that the carrying device is secured to the bearer across his/her chest and under the arms, so the child may be transported. Moreover, an invention like this can be easily packed into a car, pram or other means of transport, since it often will serve as a supplement to other ways of transporting the child. See drawings for a further description.

Figure 5:
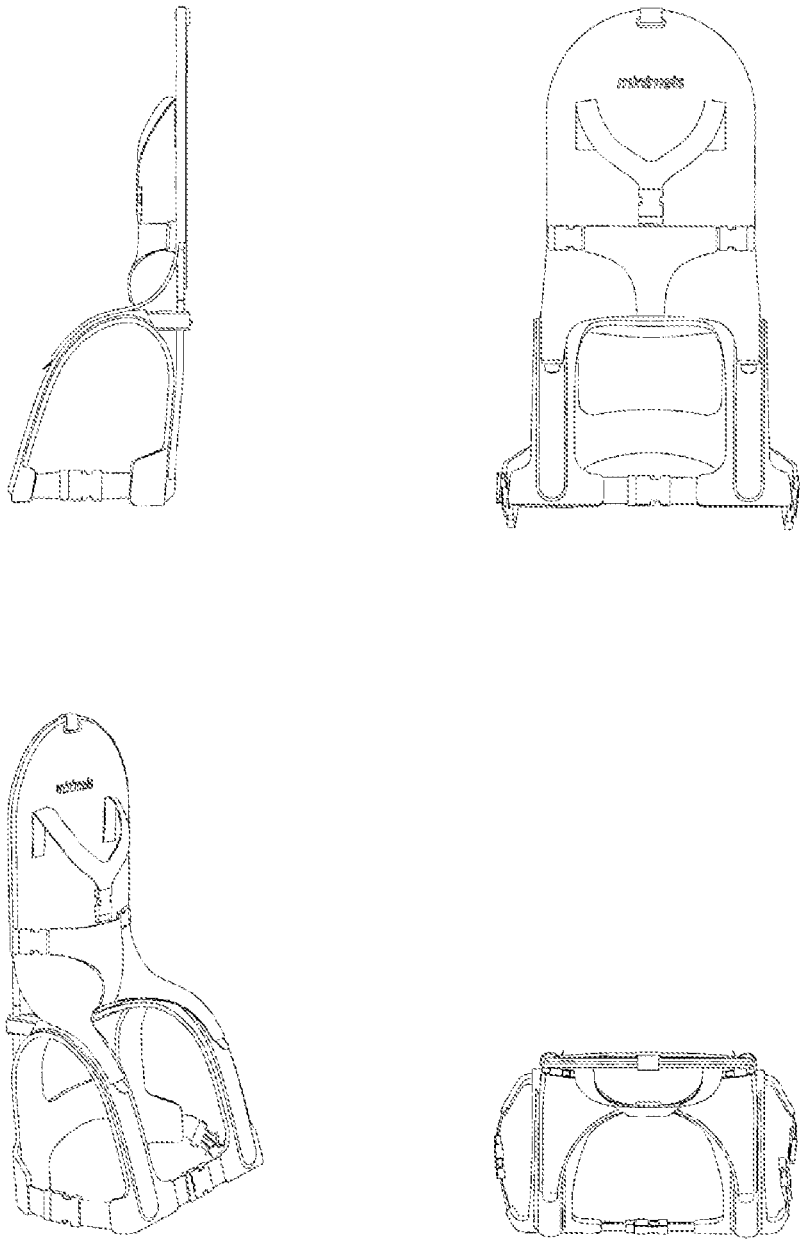
FIG. 5 shows several perspective views of a collapsible and flexible shoulder-carrying device according to an embodiment of the invention.

FIG. 5 shows several perspective views of a collapsible and flexible shoulder-carrying device according to an embodiment of the invention.

All materials must be adapted so that they at all times can withstand the use and wear that the weight of the child exerts on the device in accordance with approved design specifications, including those for metal, carbon tubes, plastics, textiles or other suitable materials.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A collapsible flexible shoulder-borne carrying device, comprising:

a foldable lumbar support;

two support bars attached to the lumbar support at respective attachment positions on the lumbar support, wherein the support bars extend transversely from the lumbar support atm the respective attachment positions, upper parts of the support bars are rigid, lower parts of the respective support bars include a free end that is pliable and bent inward toward a lower part of the lumbar support and provide open arches between the lumbar support and the support bars, the support bars are rotatably attached to the lumbar support via through holes at attachment ends of the support bars for adjustment of width between the support bars;

a support harness with fasteners, secured to the free ends of the support bars, and secured to respective free ends of the lumbar support, fastening the open arches in a desired position;

a seat cover secured to an upper part of the lumbar support and including at least one support strap and a leg restraint in a lower part of the seat cover;

first and second safety straps fastened to respective locations on a lower part of the lumbar support and connecting the support bars to the lumbar support; and length-adjustable safety straps and a first fastener for connecting first ends of the length-adjustable safety straps to each other, wherein second ends of the length-adjustable safety straps are connected to respective support bars.

2. The collapsible flexible shoulder-borne carrying device according to claim 1, wherein the support bars are flexible for adjustment to shoulder size.

3. The collapsible flexible shoulder-borne carrying device according to claim 1, wherein the lumbar support includes a spring-loaded hinge joint and is foldable between a packed state and a functional state about an axis of the spring-loaded hinge joint.

4. The collapsible flexible shoulder-borne carrying device according to claim 1, wherein the at least one support strap includes a second fastener.

5. A method of using the collapsible flexible shoulder-borne carrying device according to claim 3, comprising:

holding an upper part of the carrying device;

opening a locking strap that maintains the carrying device in the packed state, allowing gravity to rotate a lower part of the lumbar support around the axis of the hinge joint toward the functional state, wherein, when the lower part of the lumbar support rotates 180 degrees, springs of the hinge joint lock the hinge joint;

placing a child on the seat cover in the carrying device;

securing the child with the leg restraint and the at least one support strap;

lifting the carrying device with the child above a bearer's head;

placing the carrying device on shoulders of the bearer from above the shoulders of the bearer;

securing the first and second safety straps under respective arms of the bearer; and securing the length-adjustable safety straps by connecting the first ends of the length-adjustable safety straps together with the first fastener.

6. The method of using a collapsible flexible shoulder-borne carrying device according to claim 5, further comprising, after removing the child, folding the carrying device to the packed state by:

rotating the support bars towards the lumbar support in positions overlapping each other and the lumbar support;

releasing and rotating the hinge joint; and folding the upper part and the lower part of the lumbar support together.

* * * * *